US011213082B1

(12) United States Patent
Yang

(10) Patent No.: US 11,213,082 B1
(45) Date of Patent: Jan. 4, 2022

(54) SEAMLESS COMPRESSION GARMENTS

(71) Applicant: Paul Yang, Vernon, CA (US)

(72) Inventor: Paul Yang, Vernon, CA (US)

(73) Assignee: Paul Yang, Vernon, CA (US)

( * ) Notice: Subject to any disclaimer, the term of this patent is extended or adjusted under 35 U.S.C. 154(b) by 389 days.

(21) Appl. No.: 15/983,806

(22) Filed: May 18, 2018

Related U.S. Application Data

(60) Provisional application No. 62/507,885, filed on May 18, 2017.

(51) Int. Cl.
*A41D 27/00* (2006.01)
*A41D 1/08* (2018.01)
*A41B 1/08* (2006.01)

(52) U.S. Cl.
CPC ..... *A41D 27/00* (2013.01); *A41B 1/08* (2013.01); *A41D 1/08* (2013.01); *A41D 2400/38* (2013.01); *A41D 2500/10* (2013.01); *A41D 2600/10* (2013.01)

(58) Field of Classification Search
CPC . A41B 1/08; A41D 1/08; A41D 27/00; A41D 2400/38; A41D 2500/10; A41D 2600/10
USPC ..... 2/69
See application file for complete search history.

(56) References Cited

U.S. PATENT DOCUMENTS 2,074,119 A * 3/1937 Boysen ..... D04B 21/20 66/175
3,748,870 A * 7/1973 Fregeolle ..... D04B 1/108 66/177
3,824,812 A * 7/1974 Matthews ..... D04B 1/243 66/177
4,007,835 A * 2/1977 Klothe ..... A41D 27/06 206/411
4,086,790 A * 5/1978 Hanrahan, Jr. ..... D04B 1/243 66/178 A
4,089,064 A * 5/1978 Chandler, Jr. ..... A41B 11/003 2/404
7,043,942 B2 * 5/2006 Chapman ..... D04B 1/18 66/177

(Continued)

OTHER PUBLICATIONS

Product Listing—Pellon(R) Projects. Pelion Projects Website. Google Search on Aug. 1, 2020. Retrieved from Feb. 1, 2013. http://www.pellonprojects.com/wp-content/uploads/2013/01/Pellon.2018.ProductListing.pdf (Year: 2013).*

*Primary Examiner* — Clinton T Ostrup
(74) *Attorney, Agent, or Firm* — Blank Rome LLP

(57) ABSTRACT

A seamless compression garment providing gradual steps of compression from top to bottom of the garment as worn, while following contours of the body of the wearer. Transition of the various steps of compression are seamless, without sewing. A compression garment top may include first, second, and third fabric portions disposed about a circumference of the garment, the first fabric portion having a high compression rating, the second fabric portion located above the first fabric portion and having a medium compression rating, the third fabric portion located below the first fabric portion and having a medium compression rating. A compression legging garment may include first, second, third or more fabric portions disposed about the garment, each fabric portion having a strategically designed compression rating. Where specifically located stretch resistance and material hold is desired, stretch fusing can be applied to certain segments of one or more fabric portions.

18 Claims, 4 Drawing Sheets

(56) References Cited

Figure 3A:
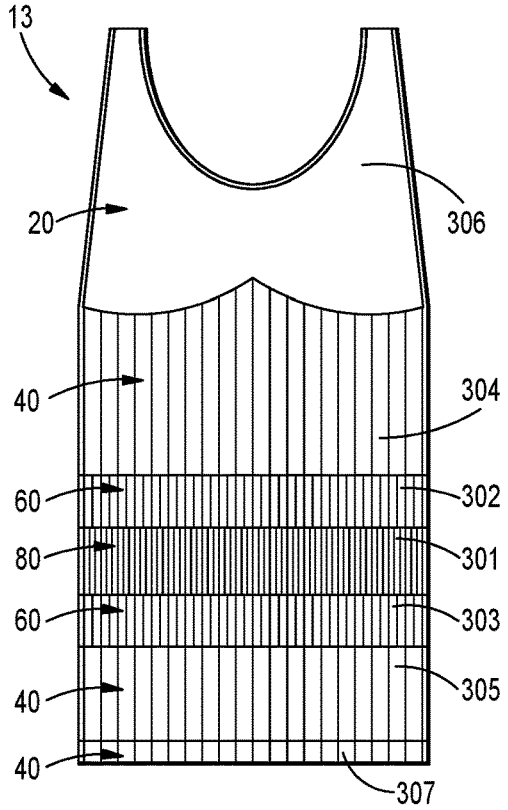

U.S. PATENT DOCUMENTS 7,159,621 B2 * 1/2007 Shannon ..... A41B 9/001 139/422
7,516,498 B2 * 4/2009 Torry ..... A41D 1/08 2/69
7,856,668 B2 * 12/2010 Demarest ..... A41D 13/02 2/69
9,345,275 B2 * 5/2016 Albin ..... A41D 1/08
10,051,897 B2 * 8/2018 Freddi ..... A41D 1/08
2004/0107479 A1 * 6/2004 Dicker ..... A41D 13/0015 2/227
2006/0169004 A1 * 8/2006 Belluye ..... A41D 13/0015 66/177
2007/0022510 A1 * 2/2007 Chapuis ..... A61F 13/10 2/69
2008/0120757 A1 * 5/2008 Nakazawa ..... A41D 13/0015 2/22
2010/0130903 A1 * 5/2010 Rock ..... D04B 1/246 602/62
2010/0299799 A1 * 12/2010 Belluye ..... A41D 13/0015 2/69
2011/0271415 A1 * 11/2011 Torry ..... A41D 13/065 2/23
2011/0302686 A1 * 12/2011 Chapuis ..... A41D 13/0015 2/69
2013/0047313 A1 * 2/2013 Windisch ..... A41D 13/0015 2/69
2014/0000005 A1 * 1/2014 Berns ..... A41D 13/0015 2/79
2014/0075656 A1 * 3/2014 Chang ..... A41D 13/0015 2/455
2014/0082815 A1 * 3/2014 Harber ..... A41B 11/003 2/69
2014/0366585 A1 * 12/2014 Shen ..... D04B 21/06 66/175
2016/0338417 A1 * 11/2016 Kehler ..... D04B 21/18
2016/0338424 A1 * 11/2016 Kehler ..... D04B 21/18
2016/0339286 A1 * 11/2016 Kehler ..... A63B 21/00178
2018/0035727 A1 * 2/2018 Cumiskey ..... A41D 13/0015
2018/0049482 A1 * 2/2018 Erkus ..... A41D 1/06
2018/0318693 A1 * 11/2018 Corrigan ..... A41D 13/0506
2018/0325188 A1 * 11/2018 Burhance ..... B32B 5/028
2019/0192894 A1 * 6/2019 Kehler ..... A63B 23/0205

* cited by examiner

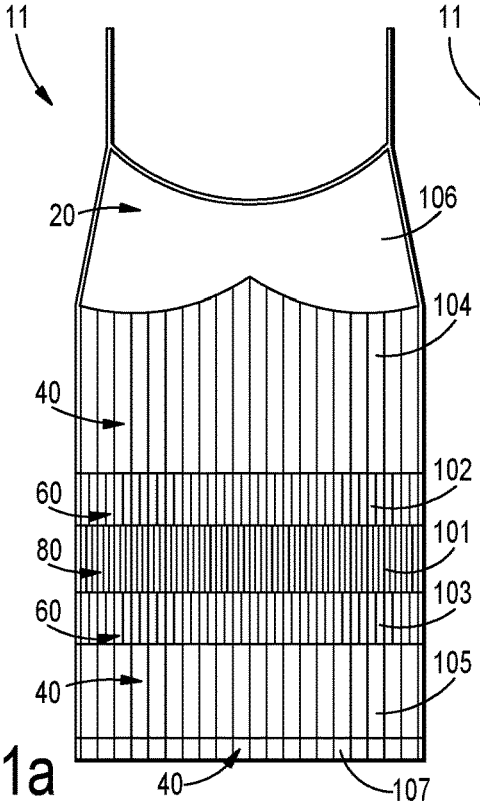
FIG. 1a
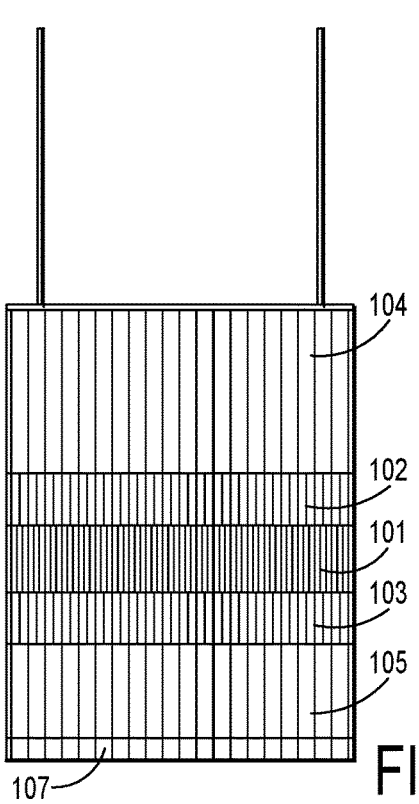
FIG. 1b
FIG. 2a
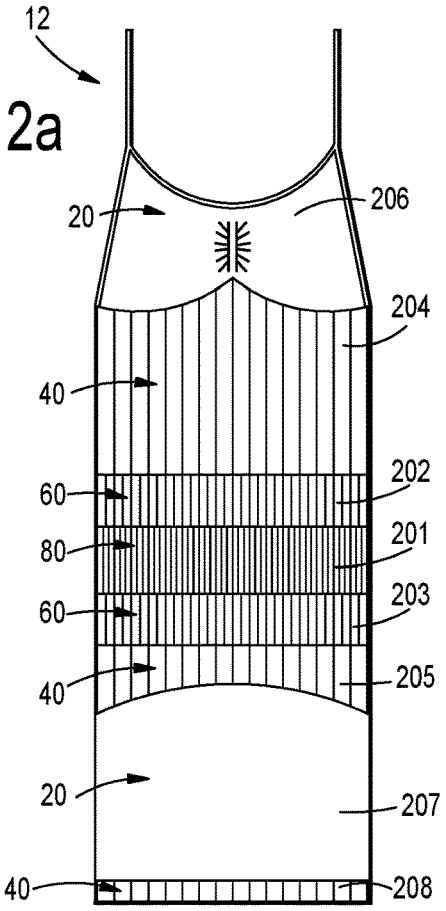
FIG. 2b
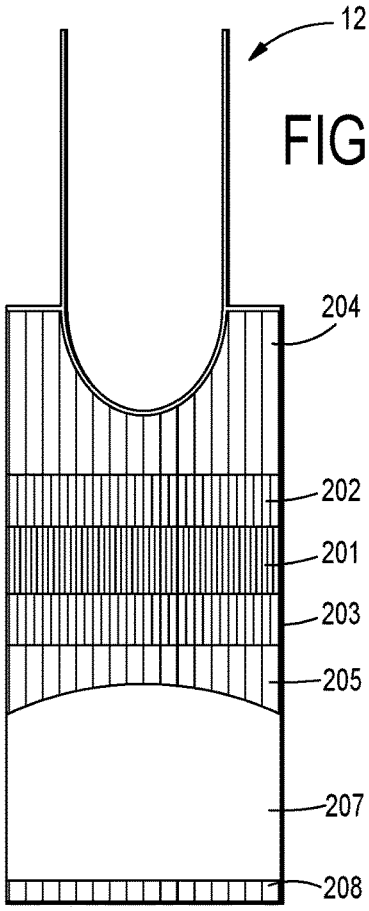

SEAMLESS COMPRESSION GARMENTS

RELATED APPLICATION

This application claims benefit of priority of U.S. Provisional Application Serial No. 62/507,885, filed May 18, 2017; which application is incorporated herein by reference.

FIELD OF THE INVENTION

The present invention relates generally to seamless compression garments, and more particularly to seamless garments providing gradual steps of compression from top to bottom of the garment, without sewing, while following contours of the body.

BACKGROUND OF THE INVENTION

Compression garments for competitive athletes is known. What is needed in the art is a seamless compression garment that is essentially a hybrid between traditional shape wear and fashionable clothing; a garment that also supports, smooths and conceals bulging or sensitive body areas.

SUMMARY OF THE INVENTION

The present invention is directed to seamless compression garments providing gradual steps of compression from top to bottom of the garment (where top to bottom of the garment is relative to how the garment is worn by a user/wearer), while following contours of the body of the user/wearer. The present invention involves differential compression, providing a seamless garment having gradual steps of compression, where transition of the various steps of compression are seamless, without sewing. From the top, the garment might begin by providing a circular zone of minimal compression, then slightly change to low compression, then slightly change to medium compression, then slightly change to high compression, then slightly change back to medium compression, then slightly change back to low compression, and finally slightly change back to minimal compression.

In one embodiment, a compression garment (e.g., a woman's top), could include a first fabric portion disposed about a circumference of the garment, the first fabric portion having a high compression rating. The garment could also include a second and a third fabric portion disposed about a circumference of the garment; the second fabric portion located above the first fabric portion and the third fabric portion located below the first fabric portion; the second and the third fabric portions having a medium compression rating, less than the high compression rating. The transition between the first and the second fabric portion, and the second and the third fabric portion, could be seamless.

In another embodiment, the garment could also include a fourth and a fifth fabric portion disposed about a circumference of the garment. The fourth fabric portion could be located above the second fabric portion, with the fifth fabric portion located below the third fabric portion. The fourth and the fifth fabric portions could have a low compression rating, less than the medium compression rating. The transition between the fourth and the second fabric portion, and the fifth and the third fabric portion, could be seamless.

In a further embodiment, the garment might also include a sixth fabric and/or a seventh fabric portion. The sixth fabric portion might be disposed about at least a portion of a circumference of the garment. The sixth fabric portion could be located above the fourth fabric portion, and could have a minimal compression rating, less than the low compression rating. The transition between the sixth and the fourth portion could be seamless. A seventh fabric portion could be disposed about a circumference of the garment, be located below fifth fabric portion, and have a minimal compression rating, less than the low compression rating. The transition between the seventh and the fifth portion could be seamless.

In certain embodiments, the high compression rating could be within a range of 6.5 to 18.1 mmHg; the medium compression rating could be within a range of 4.3 to 14.2 mmHg; the low compression rating could be within a range of 2.8 to 11.0 mmHg; and the minimal compression rating could be within a range of 1.6 to 6.0 mmHg. In certain embodiments the garment could comprise 90% to 96% nylon and 4% to 10% elastane. Alternatively, or in addition to the combination of nylon and spandex yarns, customized covered-yarns may be used, for example, a combination of yarns having varying elasticity, or anti-microbial properties, or wicking yarns, etc.

In one aspect, the garment is configured to be worn on a body so that, depending on applicability to the various above-identified embodiments, the first fabric portion, when the garment is worn on a body, is located between an upper waist area and a lower midriff area of the body; the second fabric portion is located between an upper torso and the upper waist area of the body; the third fabric portion is located between the lower midriff area and the high hip area of the body; the fourth fabric portion is located between a bust line and the upper torso area of the body; the fifth fabric portion is located between the lower midriff area and the high hip area of the body; the sixth fabric portion is located above the bust line of the body; and the seventh fabric portion is located below the high hip area of the body.

In another aspect, transition between fabric portions having different compression ratings might be contoured, where the transition dips lower at a respective sides of the garment, relative to a body of a wearer, providing that a certain compression rating is provided lower on the side of the garment relative to a front or back of the garment.

In one embodiment, a compression legging garment includes a first fabric portion, first part, disposed about a circumference of the garment, the first fabric portion; first part, having a medium compression rating. A first fabric portion, second part, and a first fabric portion, third part, are also disposed about the circumference of the garment. The first fabric portion, second part is located above the first fabric portion, first part; and the first fabric portion, third part; is located below the first fabric portion, first part. The first fabric portion, second part, has a high compression rating, greater than the medium compression rating, and the first fabric portion, third part, has a low compression rating, less than the medium compression rating. The transition between the first fabric portion, first part, and the first fabric portion, second part, and the first fabric portion, first part, and the first fabric portion, third part, is seamless.

This embodiment could further include a second, third, fourth and fifth fabric portions disposed about at least a portion of a circumference of the garment. The second fabric portion is located below the first fabric portion, third part, the third fabric portion is located below the second fabric portion, the fourth fabric portion is located below the third fabric portion, and the fifth fabric portion is located below the fourth fabric portion. The second and the fourth fabric portions have a medium compression rating, less than the high compression rating, over at least a portion thereof, and a minimal compression rating, less than the low compression rating, over at least another portion thereof. The third and the fifth fabric portions have a low compression rating less than the medium compression rating. The transition between the first fabric portion, third part, and the second fabric portion, the second and the third fabric portion, the third and the fourth fabric portion, and the fourth and the fifth fabric portion, is seamless.

In either configuration, or any permutation thereof, the garment is configured to be worn on a body so that the first fabric portion, first part, and the first fabric portion, second part, when the legging garment is worn on a body, is located about a waist area of the body. The first fabric portion, third part, is located at a transition of the waist area and an upper thigh area of the body. The second fabric portion is located about a thigh area of the body. The third fabric portion is located about a knee area of the body. The fourth fabric portion is located about a calf area of the body. The fifth fabric portion is located about an ankle area of the body.

In one aspect, the compression legging garment may include stretch fusing applied to at least the first fabric portion, first part, of the legging garment, wherein a stretch resistant fabric is fused to at least a segment of the circumference of the at least first fabric portion, first part, to provide location specific stretch resistance and hold for the at least first fabric portion, first part. The stretch resistant fabric can be manually applied to multiple segments about the circumference of the at least first fabric portion, first part, for fusing of the stretch resistant fabric to the at least first fabric portion, first part. The one or multiple segments could total approximately 50% of the circumference of the at least first fabric portion.

In another aspect, the stretch resistant fabric canoe manually applied to the multiple segments about the circumference of the at least first fabric portion, first part, by pinning, and the stretch resistant fabric is then heated and fused to the at least first fabric portion, first part. The stretch resistant fabric can be 100% Polyurethane (STC-03) and can be fused to the at least first fabric portion at approximately 3-4 bar pressure for 10-12 seconds at 270 degrees Fahrenheit.

In another embodiment of a compression legging garment, a first fabric portion is disposed about a circumference of the garment, the first fabric portion having any of the above-identified compression ratings. A second, third, fourth and fifth fabric portions are disposed about at least a portion of a circumference of the garment. The second fabric portion is located below the first fabric portion. The third fabric portion is located below the second fabric portion. The fourth fabric portion is located below the third fabric portion. The fifth fabric portion is located below the fourth fabric portion. The second and the fourth fabric portions have a medium compression rating, less than the high compression rating, over at least a portion thereof, and a minimal compression rating, less than the low compression rating, over at least another portion thereof. The third and the fifth fabric portions have a low compression rating, less than the medium compression rating. The transition between the first and the second fabric portion, the second and the third fabric portion, the third and the fourth fabric portion, and the fourth and the fifth fabric portion, is seamless.

In this another embodiment, the garment is configured to be worn on a body so that the first fabric portion, when the legging garment is worn on a body, is located about a waist area of the body and at a transition of the waist area and an upper thigh area of the body. The second fabric portion is located about a thigh area of the body. The third fabric portion is located about a knee area of the body. The fourth fabric portion is located about a calf area of the body. The fifth fabric portion is located about an ankle area of the body.

The embodiment may also include stretch fusing applied to the first fabric portion of the legging garment, where a stretch resistant fabric is fused to at least a segment of the circumference of the first fabric portion, to provide location specific stretch resistance and hold for the at least first fabric portion. The stretch resistant fabric can be manually applied, by pinning about the circumference of the first fabric portion for fusing of the stretch resistant fabric to the first fabric portion. The stretch resistant fabric can be 100% Polyurethane (STC-03) fused to the first fabric portion at approximately 3-4 bar pressure for 10-12 seconds at 270 degrees Fahrenheit.

Either compression legging embodiment, or a top compression embodiment, can include a differential compression zone. In one legging embodiment, a differential compression zone is provided at a middle top of a back of the waistband (e.g., at least the first fabric portion). The differential compression zone is seamless, can have a half-moon design, and can include varying levels of differential compression material to allow the waistband (e.g., at least the first fabric portion) to conform to a natural lower back arch of a body wearing the garment.

BRIEF DESCRIPTION OF THE ILLUSTRATED EMBODIMENTS

Figure 3B:
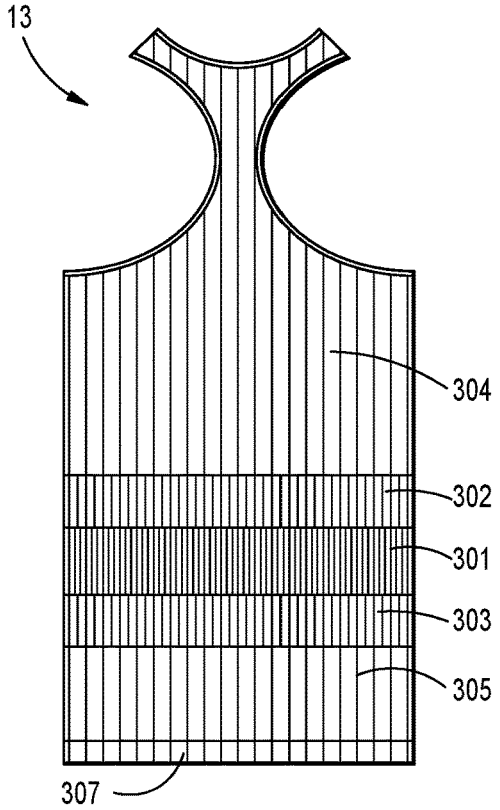
Figure 4A:
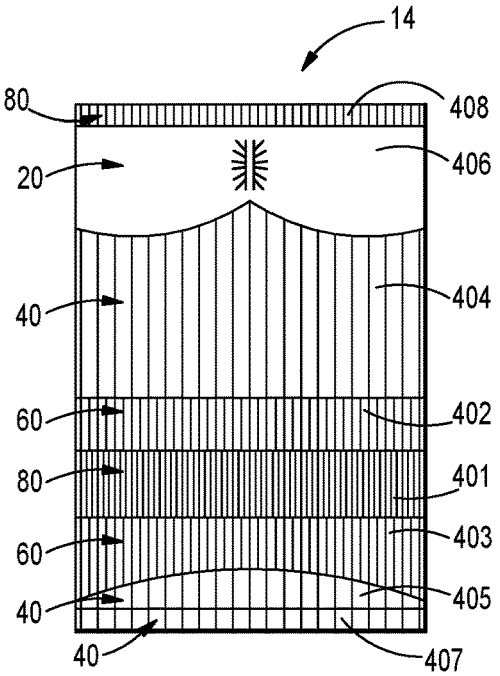
Figure 4B:
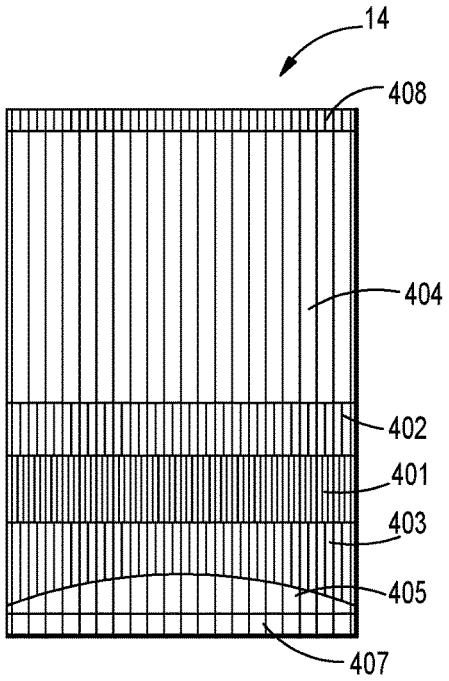
Figure 5A:
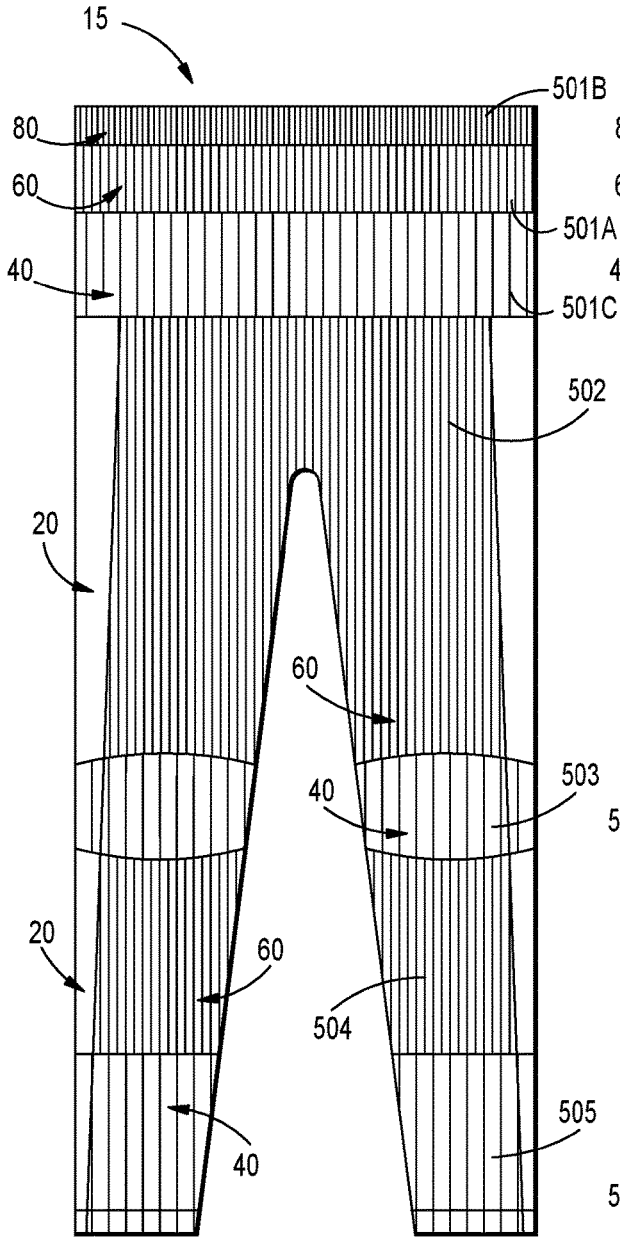
Figure 5B:
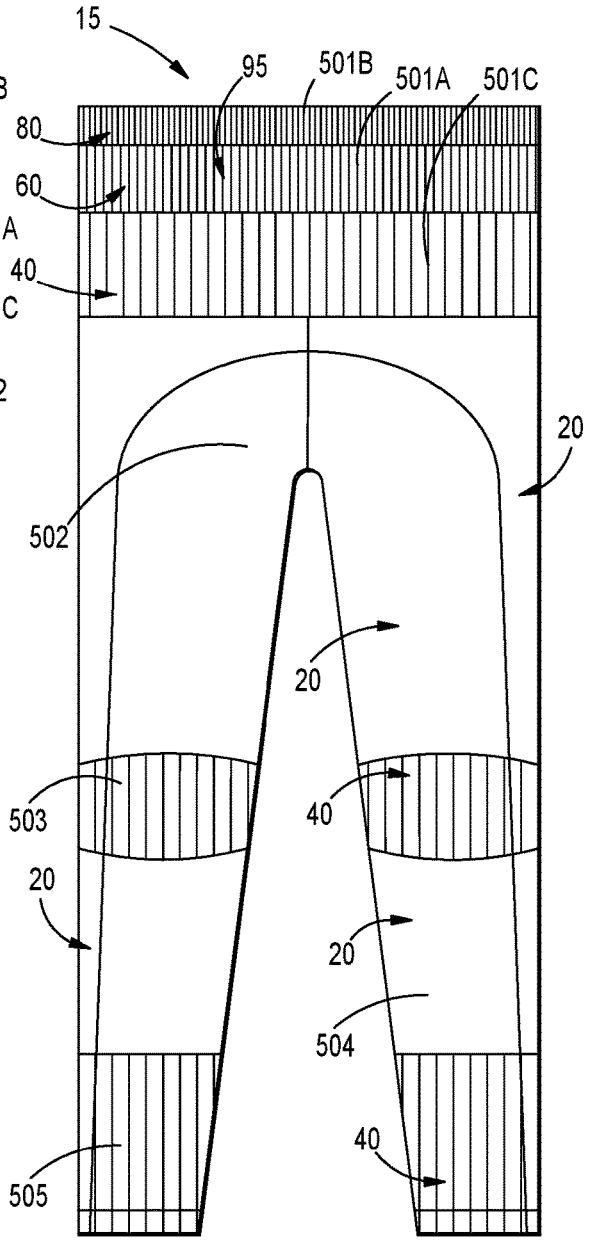
Figure 6A:
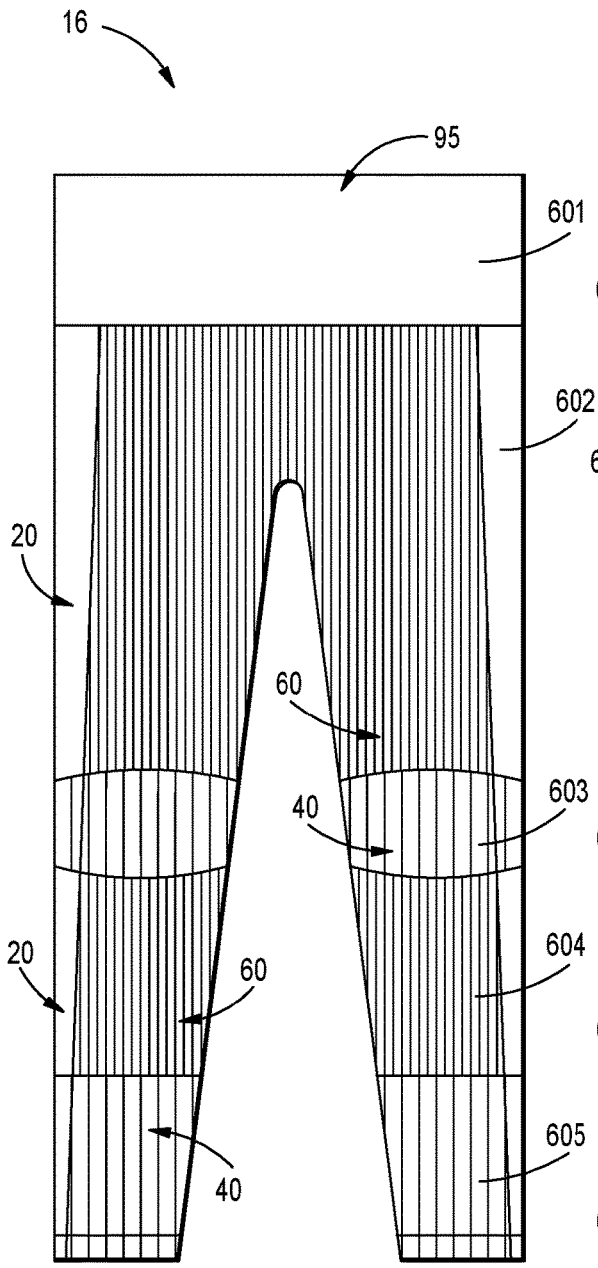
Figure 6B:
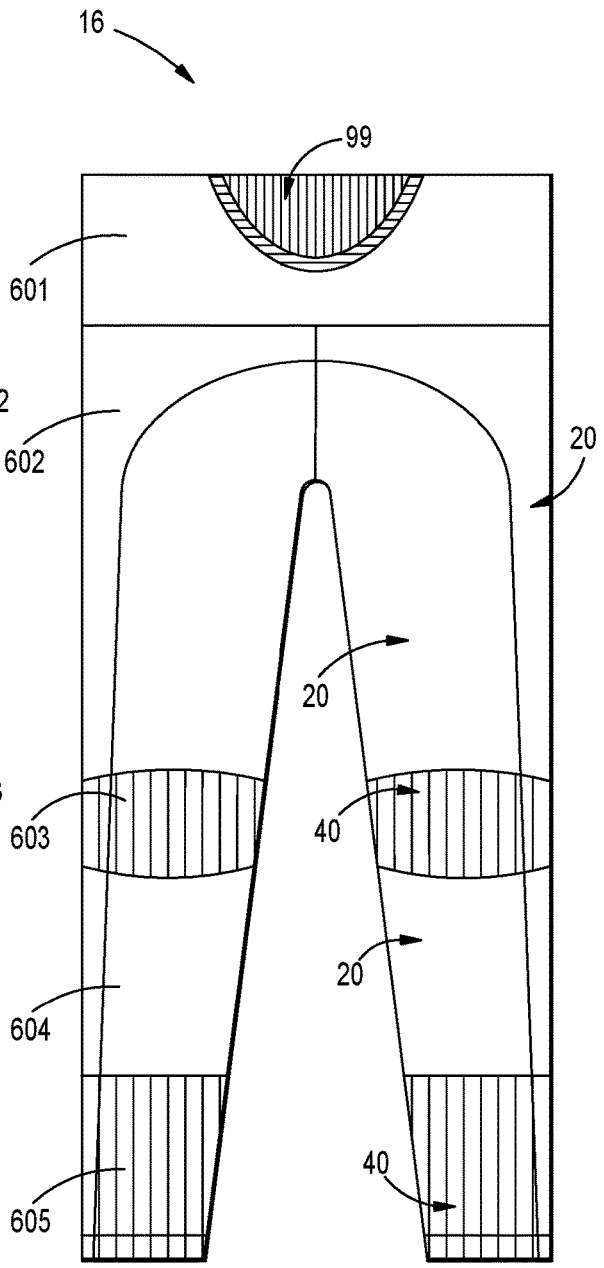

The present invention will be better understood with reference to the following description taken in combination with the drawings. For the purpose of illustration, there are shown in the drawings certain embodiments of the present invention. It should be understood, however, that the invention is not limited to the precise arrangements, dimensions, and instruments shown:

FIGS. 1*a* and 1*b* illustrate a front and a back of a camisole top, in accordance with one embodiment of the present invention;

FIGS. 2*a* and 2*b* illustrate a front and a back of a slip, in accordance with one embodiment of the present invention;

FIGS. 3*a* and 3*b* illustrate a front and a back of a tank top, in accordance with one embodiment of the present invention;

FIGS. 4*a* and 4*b* illustrate a front and a back of a tube top, in accordance with one embodiment of the present invention;

FIGS. 5*a* and 5*b* illustrate a front and a back of leggings, in accordance with one embodiment of the present invention; and FIGS. 6*a* and 6*b* illustrate a front and aback of leggings, in accordance with another embodiment of the present invention.

DETAILED DESCRIPTION OF THE ILLUSTRATED EMBODIMENTS

The present invention is directed to a new type of seamless garment (e.g., somewhat of a hybrid between traditional shape wear and fashionable clothing). Many individuals need support in particular areas of the body (e.g., around the lower stomach area) and have, in the past, used shape wear to achieve a smoother silhouette. Shape wear is meant to be out of sight, and worn under clothing.

In the present invention, compression zones are strategically placed throughout garment wear to provide a smoother silhouette (e.g., that women want), and each garment has fashionable appeal so it can be worn on its own, or layered.

The present invention uses uniquely designed varying levels of minimal, low, medium, and high compression technology, which result in aesthetically different textural rib design patterns. The present invention involves differential compression, providing a seamless garment having gradual steps of compression, where transition between the various steps of compression are seamless, without sewing.

Each garment embodiment is uniquely constructed and knit-down with a custom combination of nylon and spandex yarns. Alternatively, or in addition to the combination of nylon and spandex yarns, customized covered-yarns may be used, for example, a combination of yarns having varying elasticity, or anti-microbial properties, or wicking yarns, etc.

The present invention provides a unique and novel combination of yarns, design patterns, and constructed compression, all in one garment. The unique stitching and compression techniques of the present invention are an outcome of knowledge and experience derived from years of trial, error, and testing—all to reach the best final product. Overall, the present invention provides a product giving strongest support where needed most, to compress the most (e.g., within a mid to lower stomach region). The embodiments of the present invention can provide compressions about an entire circumference, to provide support completely encircling a body.

In the various embodiments, as you move away from a high compression region, each new compression region can provide less and less compression, resulting in a feeling of comfort and smooth transition from one type of compression to the next, as the compression regions are placed side-by-side (in small increments of increases and decreases). The compression regions can also have seamless transition from region to region.

Referring now to the drawings, FIGS. 1-5 show various embodiments (various garments) of the present invention. Various embodiments of the present invention provide gradual steps of compression (e.g., from top to bottom of the garment, where top to bottom of the garment is relative to how the garment is worn by a user/wearer) while following contours of a body of the user/wearer.

In one aspect, an embodiment may begin, from top to bottom of the garment (relative to how the garment is worn on a body), with minimal compression; then slightly change to low compression; then slightly change to medium compression; then slightly change to high compression; then slightly change back to medium compression; then slightly change back to low compression; and finally slightly change back to minimal compression.

The various regions of compression, as that region relates to a garment (e.g., a woman's top), and relates to how that garment is worn by a body, could be described as follows:

Minimal Compression region—flat material with very little compression. Starting at a top of the garment and ending at a bust line of a body, when the garment is worn on the body, this region allows freedom and comfort for chest region.

Low Compression region—starting at the bust line and ending at an upper torso area of the body. This region provides low level support and can wrap a circumference of the body.

Medium Compression region—provides medium compression, starting at the upper torso and ending at waist area of the body. In this region, compression is raised slightly from the low compression region, to gradually gain support for an upper stomach area of the body, and can wrap the circumference of the body.

High Compression region provides high compression, starting at an upper waist area of the body, or at the waist area, and ending at a lower midriff area of the body. This region can be located around an area of the stomach. Many individuals need support in this area of the body (due to a protruding stomach, or lower stomach), perhaps more so than any other area of the body. This region can also bring support to the circumference of the body.

Medium Compression region (again)—provides medium compression again, starting at the lower midriff area of the body and continuing into the high hip area. This medium compression region can also bring support to the circumference of the body.

Low Compression region (again)—provides a gradual level of change from medium compression back to low compression, as an individual's middle to low hip area needs little to no support. This region can bring support to the circumference of the body. A contour of this region can dip down at respective sides to better blend with a minimal compression region beneath it.

Minimal Compression region (again) again provides flat material with very little compression, allowing freedom at a bottom of the garment.

The respectively repeated minimal, low and medium compression regions may each have the same level of compression (relative to its respectively repeated region), or the repeated regions may have a similar degree of compression, or may provide a degree of compression within a respective range. For example, a medium compression region may have a compression rating of 9.3 mmHg, or may have a compression rating within a range of approximately 4.3 to 14.2 mmHg. In further examples: a minimal compression region may have a compression rating of 3.1 mmHg, or may have a compression rating within a range of approximately 1.6 to 6.0 mmHg; a low compression region may have a compression rating of 6.7 mmHg, or may have a compression rating within a range of approximately 2.8 to 11.0 mmHg, and a high compression region may have a compression rating of 12.4 mmHg, or may have a compression rating within a range of approximately 6.5 to 18.1 mmHg.

In one aspect of the invention, each section of differential compression is designed with a different stitch pattern, which when knitted gives a varying level of compression. Generally, circular knitting machines are used.

In another aspect, a certain combination of yarns are used for each of various fits (within which various sizes might be provided, thereby providing a respective permutation to total size offerings for any given garment), In one example, three fit categories are provided and three sizes are provided for each fit category, thereby providing 9 total garment embodiments. Fit categories can be SLIM FIT, ATHLEISURE FIT and CURVY FIT, and sizes within each category could be small S, medium M and large L.

In a further aspect, yarn setup percentages for each of the three fits can be as follows: SLIM FIT in 5, M and L: 90% nylon and 10% elastane; ATHLEISURE FIT in 5, NI, and 92% nylon and 8% elastane; and CURVY FIT in 5, M, and L: 96% nylon and 4% elastane.

In certain aspects, the following compression rating (in mmHg), for each compression region, can be provided for each fit category:

| | SLIMFIT | ATHLEISURE | CURVY |
|---|---|---|---|
| Minimal | 6.0 | 3.1 | 1.6 |
| Low | 11.0 | 6.7 | 2.8 |
| Medium | 14.2 | 9.3 | 4.3 |
| High | 18.1 | 12.4 | 6.5 |

Stretch fusing can be applied to one or more fabric portions of a compression garment of the present invention, whether a top or bottom. Stretch fusing would be applicable anywhere additional stretch resistance or holding purpose is desired in the garment (e.g., in a waist area (or waistband) of leggings, or about a top of a tube top). Stretch fusing is directed to providing just enough stretchable opening and flexibility when moving within the garment, and when taking the garment on and off, while also providing enough securement to hold the garment in place while moving within the garment.

Stretch fusing can be applied to one or more fabric portions of the compression garment. In this aspect, stretch resistant fabric is fused to at least one segment of (or the entirety of) the circumference of a fabric portion, to provide location specific stretch resistance and hold for the fabric portion (e.g., in a waistband of leggings). The benefits of stretch fusing for seamless garments are optimal overall support, lightweight compression, comfort, and a much smoother silhouette than typical seamless ribbing compression. Stretch fusing also allows a garment to provide quicker and longer-lasting recovery, while offering a cleaner finish along the hem than typical ribbed compression.

One or multiple segments of the respective fabric portion, about the circumference of the fabric portion, can have stretch fusing applied thereto. For example, the one or more segments can total approximately 15% to 75% of the circumference of the respective fabric portion. In more specific aspects, the one or multiple segments about the circumference of the respective fabric portion can total approximately 25% of the circumference of the fabric portion, or total 50% of the circumference of the fabric portion.

In one aspect, a stretch resistant fabric is applied to the one or more segments of the respective fabric portion, about the circumference of the fabric portion, and the stretch resistant fabric is heated and thereby fused to the fabric portion. In another aspect, a 100% Polyurethane (HTS code for STC-03 is 3926 9090) fabric is pressed between two pieces of nylon spandex at approximately 3-4 bar pressure for 10-12 seconds at 270 degrees Fahrenheit.

In one embodiment, the stretch fusing process is performed manually, by hand, using a heat press machine and an iron. The manual, multi-step process adds value to the garment, and ensures quality. Normally, with nylon spandex fabric, it is difficult to apply fusing with heat because the fabric melts when the temperature, time and pressure are too high, or are not properly balanced. Also, if temperature, time and pressure are too low, or are not properly balanced, the fusing does not apply, or is not adequate, Control of temperature, time and pressure is crucial, and manual application ensures a proper application. Further, when applying fusing, an edge of the fabric portion band requires more heating time and pressure than a center of the fabric portion band.

Accordingly, an embodiment of a method of performing or applying stretch fusing includes manually applying (e.g., by pinning) a stretch resistant fabric to one or more segments of a respective fabric portion, and manually applying heat to fuse the stretch resistant fabric to the respective fabric portion. This embodiment could include manually pinning a 100% Polyurethane (HTS code for STC-03 is 3926 9090) fabric between two pieces of a nylon spandex fabric portion, and pressing at approximately 3-4 bar pressure for 10-12 seconds at 270 degrees Fahrenheit. In specific embodiments, this stretch fusing method is applied to one or multiple segments about the circumference of the respective fabric portion totaling approximately 50% (or 25%) of the circumference of the fabric portion.

Specific locations of a compression garment (top or bottom) may benefit from, and can include, differential compression zones. With a traditional spandex legging waistband, typically a gap occurs between a middle top of the waistband and a lower mid-back area of a body wearing the garment. This occurs because a typical spandex waistband is constructed in such a way that does not allow the waistband to conform to the body's natural curves. To eliminate this occurrence (e.g., eliminate the gap, and allow the waistband to conform to the natural curve of the body), one embodiment of the present invention incorporates a seamless half-moon design constructed of varying levels of differential compression (a differential compression zone). The differential compression zone allows the waistband to curve and conform to a natural lower back arch of a body, and to lay comfortably against the body. Differential compression zones are not limited to the mid-back area of a waistband, but can be applied to any specific location of a compression garment (top or bottom) that may benefit from better garment conformance to a natural curve of a body. In addition, seamless half-moon designs are not the only contemplated shape of a differential compression zone. Other shapes include, without limitation, circular, oval, diamond, square (any shape that best represents an area where better garment conformance to a natural curve of a body can be provided).

FIGS. 1*a* and 1*b* illustrate a front and a back of a camisole top compression garment 11, in accordance with one embodiment of the present invention. In this embodiment, the camisole top compression garment 11 includes a first fabric portion 101 disposed about a circumference of the garment 11, the first fabric portion 101 having a high compression rating 80. A second 102 and a third 103 fabric portions are disposed about the circumference of the garment 11, with the second fabric portion 102 located above the first fabric portion 101, and the third fabric portion 103 located below the first fabric portion 101. The second 102 and the third 103 fabric portions have a medium compression rating 60, less than the high compression rating 60. The transition between the first 101 and the second 102 fabric portion, and the first 101 and the third 103 fabric portion, is seamless (e.g., without sewing between portions).

The camisole top compression garment 11 of FIGS. 1*a* and 1*b* also includes a fourth 104 and a fifth 105 fabric portion disposed about the circumference of the garment 11. The fourth fabric portion 104 is located above the second fabric portion 102, and the fifth fabric portion 105 is located below the third fabric portion 103. The fourth 104 and the fifth 105 fabric portions have a low compression rating 40, less than the medium compression rating 60. The transition between the fourth 104 and the second 102 fabric portion, and the fifth 105 and the third 103 fabric portion, is seamless.

The camisole top compression garment 11 of FIGS. 1*a* and 1*b* also includes a sixth fabric portion 106 disposed about at least a portion of the circumference of the garment 11. The sixth fabric portion 106 is located above the fourth fabric portion 104. The sixth fabric portion 106 has a minimal compression rating 20, less than the low compression rating 40. The transition between the sixth 106 and the fourth 104 portion is seamless. Also included is a seventh fabric portion 107 disposed about the circumference of the garment 11. The seventh fabric portion 107 is located below the fifth fabric portion 105. The seventh fabric portion 107 has a low compression rating, similar to the fifth fabric portion 105. Any transition between the seventh 107 and the fifth 105 fabric portion is seamless.

The camisole top compression garment 11 of FIGS. 1*a* and 1*b* could comprise 90% to 96% nylon and 4% to 10% elastane. The garment 11 could comprise yarns selected from the group consisting of customized yarns of varying elasticity, anti-microbial yarns and wicking yams. In this embodiment, the high compression rating 80 is within a range of 6.5 to 18.1 mmHg; the medium compression rating 60 is within a range of 4.3 to 14.2 mmHg; the low compression rating 40 is within a range of 2.8 to 11.0 mmHg; and the minimal compression rating 20 is within a range of 1.6 to 6.0 mml-Ig. In one specific embodiment, the high compression rating 80 is 18.1 mmHg the medium compression rating 60 is 14.2 mmHg; the low compression rating 40 is 11.0 mmHg, and the minimal compression rating 20 is 6.0 mmHg. In another specific embodiment, the high compression rating 80 is 12.4 mmHg; the medium compression rating 60 is 9.3 mmHg; the low compression rating 40 is 6.7 mmHg; and the minimal compression rating 20 is 3.1 mmHg. In still another specific embodiment, the high compression rating 80 is 6.5 mmHg; the medium compression rating 60 is 4.3 mmHg; the low compression rating 40 is 2.8 mmHg; and the minimal compression rating 20 is 1.6 mmHg.

The camisole top compression garment 11 of FIGS. 1*a* and 1*b* is configured to be worn on a body, and can be configured so that the first fabric portion 101, when the garment is worn on a body, is located between an upper waist area and a lower midriff area of the body; the second fabric portion 102 is located between an upper torso and the upper waist area of the body; the third fabric portion 103 is located between the lower midriff area and the high hip area of the body; the fourth fabric portion 104 is located between a bust line and the upper torso area of the body; the fifth fabric portion 105 is located between the lower midriff area and the high hip area of the body; the sixth fabric portion 106 is located above the bust line of the body; and the seventh fabric portion 107 is located below the high hip area of the body.

FIGS. 2*a* and 2*b* illustrate a front and a back of a slip compression garment 12, in accordance with one embodiment of the present invention. In this embodiment, the slip compression garment 12 includes a first fabric portion 201 disposed about a circumference of the garment 12, the first fabric portion 201 having a high compression rating 80. A second 202 and a third 203 fabric portions are disposed about the circumference of the garment 12, with the second fabric portion 202 located above the first fabric portion 201, and the third fabric portion 203 located below the first fabric portion 201. The second 202 and the third 203 fabric portions have a medium compression rating 60, less than the high compression rating 80. The transition between the first 201 and the second 202 fabric portion, and the first 201 and the third 203 fabric portion, is seamless (e.g., without sewing between portions).

The slip compression garment 12 of FIGS. 2*a* and 2*b* also includes a fourth 204 and a fifth 205 fabric portion disposed about the circumference of the garment 12. The fourth fabric portion 204 is located above the second fabric portion 202, and the fifth fabric portion 205 is located below the third fabric portion 203. The fourth 204 and the fifth 205 fabric portions have a low compression rating 40, less than the medium compression rating 60. The transition between the fourth 204 and the second 202 fabric portion, and the fifth 205 and the third 203 fabric portion, is seamless.

The slip compression garment 12 of FIGS. 2*a* and 2*b* also includes a sixth fabric portion 206 disposed about at least a portion of the circumference of the garment 12. The sixth fabric portion 206 is located above the fourth fabric portion 204. The sixth fabric portion 206 has a minimal compression rating 20, less than the low compression rating 40. The transition between the sixth 206 and the fourth 204 fabric portion is seamless. Also included is a seventh fabric portion 207 disposed about the circumference of the garment 12. The seventh fabric portion 207 is located below fifth fabric portion 205. The seventh fabric portion 207 has a minimal compression rating 20, less than the low compression rating 40. The transition between the seventh 207 and the fifth 205 fabric portion is seamless. Lastly, also included is an eighth fabric portion 208 disposed about the circumference of the garment 12. The eighth fabric portion 208 is located below the seventh fabric portion 207. The eighth fabric portion 208 has a low compression rating 40, greater than the minimal compression rating 20. The transition between the eighth 208 and the seventh 207 fabric portion is seamless.

The slip compression garment 12 of FIGS. 2*a* and 2*b* could comprise 90% to 96% nylon and 4% to 10% elastane. The garment 12 could comprise yarns selected from the group consisting of customized yarns of varying elasticity, anti-microbial yarns and wicking yarns. In this embodiment, the high compression rating 80 is within a range of 6.5 to 18.1 mmHg; the medium compression rating 60 is within a range of 4.3 to 14.2 mmHg; the low compression rating 40 is within a range of 2.8 to 11.0 mmHg; and the minimal compression rating 20 is within a range of 1.6 to 6.0 mmHg. In one specific embodiment, the high compression rating 80 is 18.1 mmHg, the medium compression rating 60 is 14.2 mmHg; the low compression rating 40 is 11.0 mmHg, and the minimal compression rating 20 is 6.0 mmHg. In another specific embodiment, the high compression rating 80 is 12.4 mmHg; the medium compression rating 60 is 9.3 mmHg; the low compression rating 40 is 6.7 mmHg; and the minimal compression rating 20 is 3.1 mmHg. In still another specific embodiment, the high compression rating 80 is 6.5 mmHg; the medium compression rating 60 is 4.3 mmHg; the low compression rating 40 is 2.8 mmHg; and the minimal compression rating 20 is 1.6 mmHg.

The slip compression garment 12 of FIGS. 2*a* and 2*b* is configured to be worn on a body, and can be configured so that the first fabric portion 201, when the garment is worn on a body, is located between an upper waist area and a lower midriff area of the body; the second fabric portion 202 is located between an upper torso and the upper waist area of the body; the third fabric portion 203 is located between the lower midriff area and the high hip area of the body; the fourth fabric portion 204 is located between a bust line and the upper torso area of the body; the fifth fabric portion 205 is located between the lower midriff area and the high hip area of the body; the sixth fabric portion 206 is located above the bust line of the body; the seventh fabric portion 207 is located below the high hip area of the body, over the lower midriff area; and the eighth fabric portion 208 is located at a bottom of the garment, likely above the knee.

As shown in FIGS. 2*a* and 2*b*, the slip compression garment 12 can include a contoured transition between the fifth 205 and the seventh 207 fabric portions, where the transition dips lower at respective sides of the garment 12, providing a bringing the) low compression region 40 lower on the sides of the garment, to better blend with the minimal compression region 20 of the seventh fabric portion 207 beneath and beside the low compression region 40 of the fifth fabric portion 205.

FIGS. 3*a* and 3*b* illustrate a front and a back of a tank top compression garment 13, in accordance with one embodiment of the present invention. In this embodiment, the tank top compression garment 13 includes a first fabric portion 301 disposed about a circumference of the garment 13, the first fabric portion 301 having a high compression rating 80. A second 302 and a third 303 fabric portions are disposed about the circumference of the garment 13, with the second fabric portion 302 located above the first fabric portion 301, and the third fabric portion 303 located below the first fabric portion 301. The second 302 and the third 303 fabric portions have a medium compression rating 60, less than the high compression rating 80. The transition between the first 301 and the second 302 fabric portion, and the first 301 and the third 303 fabric portion, is seamless (e.g., without sewing between portions).

The tank top compression garment 13 of FIGS. 3*a* and 3*b* also includes a fourth 304 and a fifth 305 fabric portion disposed about the circumference of the garment 13. The fourth fabric portion 304 is located above the second fabric portion 302, and the fifth fabric portion 305 is located below the third fabric portion 303. The fourth 304 and the fifth 305 fabric portions have a low compression rating 40, less than the medium compression rating 60. The transition between the fourth 304 and the second 302 fabric portion, and the fifth 305 and the third 303 fabric portion, is seamless.

The tank top compression garment 13 of FIGS. 3*a* and 3*b* also includes a sixth fabric portion 306 disposed about at least a portion of the circumference of the garment 13. The sixth fabric portion 306 is located above the fourth fabric portion 304. The sixth fabric portion 306 has a minimal compression rating 20, less than the low compression rating 40. The transition between the sixth 306 and the fourth 304 portion is seamless. Also included is a seventh fabric portion 307 disposed about the circumference of the garment 13. The seventh fabric portion 307 is located below the fifth fabric portion 305. The seventh fabric portion 307 has a low compression rating, similar to the fifth fabric portion 305. Any transition between the seventh 307 and the fifth 305 fabric portion is seamless.

The tank top compression garment 13 of FIGS. 3*a* and 3*b* could comprise 90% to 96% nylon and 4% to 10% elastane. The garment 13 could comprise yarns selected from the soup consisting of customized yarns of varying elasticity, anti-microbial yarns and wicking yarns. In this embodiment, the high compression rating 80 is within a range of 6.5 to 18.1 mmHg; the medium compression rating 60 is within a range of 4.3 to 14.2 mmHg; the low compression rating 40 is within a range of 2.8 to 11.0 mmHg; and the minimal compression rating 20 is within a range, of 1.6 to 6.0 mmHg. In one specific embodiment, the high compression rating 80 is 18.1 mmHg the medium compression rating 60 is 14.2 mmHg; the low compression rating 40 is 11.0 mmHg, and the minimal compression rating 20 is 6.0 mmHg. In another specific embodiment, the high compression rating 80 is 12.4 mmHg; the medium compression rating 60 is 9.3 mmHg; the low compression rating 40 is 6.7 mmHg; and the minimal compression rating 20 is 3.1 mmHg. In still another specific embodiment, the high compression rating 80 is 6.5 mmHg; the medium compression rating 60 is 4.3 mmHg; the low compression rating 40 is 2.8 mmHg; and the minimal compression rating 20 is 1.6 mmHg.

The tank top compression garment 13 of FIGS. 3*a* and 3*b* is configured to be worn on a body, and can be configured so that the first fabric portion 301; when the garment is worn on a body, is located between an upper waist area and a lower midriff area of the body; the second fabric portion 302 is located between an upper torso and the upper waist area of the body; the third fabric portion 303 is located between the lower midriff area and the high hip area of the body; the fourth fabric portion 304 is located between a bust line and the upper torso area of the body; the fifth fabric portion 305 is located between the lower midriff area and the high hip area of the body; the sixth fabric portion 306 is located above the bust line of the body; and the seventh fabric portion 307 is located below the high hip area of the body.

FIGS. 4*a* and 4*b* illustrate a front and a back of a tube top compression garment 14, in accordance with one embodiment of the present invention. In this embodiment, the tube top compression garment 14 includes a first fabric portion 401 disposed about a circumference of the garment 14, the first fabric portion 401 having a high compression rating 80. A second 402 and a third 403 fabric portions are disposed about the circumference of the garment 14, with the second fabric portion 402 located above the first fabric portion 401, and the third fabric portion 403 located below the first fabric portion 401. The second 402 and the third 403 fabric portions have a medium compression rating 60, less than the high compression rating 80. The transition between the first 401 and the second 402 fabric portion, and the first 401 and the third 403 fabric portion, is seamless (e.g., without sewing between portions).

The tank top compression garment 14 of FIGS. 4*a* and 4*b* also includes a fourth 404 and a fifth 405 fabric portion disposed about the circumference of the garment 14. The fourth fabric portion 404 is located above the second fabric portion 402, and the fifth fabric portion 405 is located below the third fabric portion 403. The fourth 404 and the fifth 405 fabric portions have a low compression rating 40, less than the medium compression rating 60. The transition between the fourth 404 and the second 402 fabric portion, and the fifth 405 and the third 403 fabric portion, is seamless.

The tube top compression garment 14 of FIGS. 4*a* and 4*b* also includes a sixth fabric portion 406 disposed about at least a portion of the circumference of the garment 14. The sixth fabric portion 406 is located above the fourth fabric portion 404. The sixth fabric portion 406 has a minimal compression rating 20, less than the low compression rating 40. The transition between the sixth 406 and the fourth 404 fabric portion is seamless. Also included is a seventh fabric portion. 407 disposed about the circumference of the garment 14. The seventh fabric portion 407 is located below fifth fabric portion 405. The seventh fabric portion 207 has a low compression rating 40, similar to that of the fifth fabric portion 405. Any, transition between the seventh 407 and the fifth 405 fabric portion is seamless. Lastly, also included is an eighth fabric portion 408 disposed about the circumference of the garment 14. The eighth fabric portion 408 is located above the sixth fabric portion 406. The eighth fabric portion 408 has a high compression rating 80, greater than the medium compression rating 60. The transition between the eighth 408 and the sixth 406 fabric portion is seamless.

The tube top compression garment 14 of FIGS. 4*a* and 4*b* could comprise 90% to 96% nylon and 4% to 10% elastane. The garment 14 could comprise yarns selected from the group consisting of customized yarns of varying elasticity, anti-microbial yarns and wicking yarns. In this embodiment, the high compression rating 80 is within a range of 6.5 to 18.1 mmHg; the medium compression rating 60 is within a range of 4.3 to 14.2 mmHg; the low compression rating 40 is within a range of 2.8 to 11.0 mmHg; and the minimal compression rating 20 is within a range of 1.6 to 6.0 mmHg. In one specific embodiment, the high compression rating 80 is 18.1 mmHg the medium compression rating 60 is 14.2 mmHg; the low compression rating 40 is 11.0 mmHg, and the minimal compression rating 20 is 6.0 mmHg. In another specific embodiment, the high compression rating 80 is 12.4 mmHg; the medium compression rating 60 is 9.3 mmHg; the low compression rating 40 is 6.7 mmHg; and the minimal compression rating 20 is 3.1 mmHg. In still another specific embodiment, the high compression rating 80 is 6.5 mmHg; the medium compression rating 60 is 4.3 mm Hg; the low compression rating 40 is 2.8 mmHg; and the minimal compression rating 20 is 1.6 mmHg.

The tube top compression garment 14 of FIGS. 4*a* and 4*b* is configured to be worn on a body, and can be configured so that the first fabric portion 401, when the garment is worn on a body, is located between an upper waist area and a lower midriff area of the body; the second fabric portion 402 is located between an upper torso and the upper waist area of the body; the third fabric portion 403 is located between the lower midriff area and the high hip area of the body; the fourth fabric portion 404 is located between a bust line and the upper torso area of the body; the fifth fabric portion 405 is located between the lower midriff area and the high hip area of the body; the sixth fabric portion 406 is located above the bust line of the body; the seventh fabric portion 407 is located around or below the high hip area of the body; and the eighth fabric portion 408 is located at a top of the garment, above the bust line and below the shoulders.

As shown in FIGS. 4*a* and 4*b*, the tube top compression garment 14 can include a contoured transition between the third 403 and the fifth 405 fabric portions, where the transition dips lower at respective sides of the garment 14, providing a (or bringing the) medium compression region 60 lower on the sides of the garment, to better blend with the low compression region 40 of the fifth fabric portion 407 beneath and beside the medium compression region 60 of the third fabric portion 403.

FIGS. 5*a* and 5*b* illustrate a front and a back of a compression legging garment 15, in accordance with one embodiment of the present invention. In this embodiment, the compression legging garment 15 includes a first fabric portion, first part 501A disposed about a circumference of the garment 15, the first fabric portion, first part 501A, having a medium compression rating 60. A first fabric portion, second part 501B and a first fabric portion, third part 501C are also disposed about the circumference of the garment 15, with the first fabric portion, second part 501B located above the first fabric portion, first part 501A, and the first fabric portion, third part 501C located below the first fabric portion, first part 501A. The first fabric portion, second part 501B has a high compression rating 80, greater than the medium compression rating 60. The first fabric portion, third part 501C has a low compression rating 40, less than the medium compression rating 60. The transition between the first fabric portion, first part 501A and the first fabric portion, second part 501B, and the first fabric portion, first part 501A and the first fabric portion, third part 501C, is seamless (e.g., without sewing between portions). Alternatively, the first fabric portion, first part 501A, the first fabric portion, second part 501B, and the first fabric portion, third part 501C could be combined into one fabric portion band about and entirety of the garment 15 waistband. The alternative waistband could be any of a high 80, medium 60, or low 40 compression rating.

The compression legging garment 15 of FIGS. 5*a* and 5*b* also include a second 502, third 503, fourth 504, and fifth 505 fabric portions disposed about at least a portion of a circumference of the garment 15. The second fabric portion 502 is located below the first fabric portion, third part 501C. The third fabric portion 503 is located below the second fabric portion 502. The fourth fabric portion 504 is located below the third fabric portion 503. The fifth fabric portion 505 is located below the fourth fabric portion 504. The second fabric portion 502 has a medium compression rating 60, less than the high compression rating 80, over a majority of a front of the garment 15, and a minimal compression rating 20, less than the low compression rating 40, around the sides and across aback of the garment 15. The third 503 and the fifth 505 fabric portions have a low compression rating 40, less than the medium compression rating 60. The fourth fabric portion 504 has a medium compression rating 60, less than the high compression rating 80, over a majority of a front of the garment 15, and a minimal compression rating 20, less than the low compression rating 40, around the sides and across a back of the garment 15. The transition between the first fabric portion, third part 501C and the second 502 fabric portion, the second 502 and the third 503 fabric portion, the third 503 and the fourth 504 fabric portion, and the fourth 504 and the fifth 505 fabric portion; is seamless.

The compression legging garment 15 of FIGS. 5*a* and 5*b* could comprise 90% to 96% nylon and 4% to 10% elastane. The garment 15 could comprise yarns selected from the group consisting of customized yarns of varying elasticity, anti-microbial yarns and wicking yarns. In this embodiment, the high compression rating 80 is within a range of 6.5 to 18.1 mmHg; the medium compression rating 60 is within a range of 4.3 to 14.2 mmHg; the low compression rating 40 is within a range of 2.8 to 11.0 mmHg; and the minimal compression rating 20 is within a range of 1.6 to 6.0 mmHg. In one specific embodiment, the high compression rating 80 is 18.1 mmHg the medium compression rating 60 is 14.2 mmHg; the low compression rating 40 is 11.0 mmHg and the minimal compression rating 20 is 6.0 mmHg. In another specific embodiment, the high compression rating 80 is 12.4 mmHg; the medium compression rating 60 is 9.3 mmHg; the low compression rating 40 is 6.7 mmHg; and the minimal compression rating 20 is 3.1 mmHg. In still another specific embodiment, the high compression rating 80 is 6.5 mmHg; the medium compression rating 60 is 4.3 mmHg; the low compression rating 40 is 2.8 mmHg; and the minimal compression rating 20 is 1.6 mmHg.

The compression legging garment 15 of FIGS. 5*a* and 5*b* is configured to be worn on a body; and can be configured so that the first fabric portion, first part 501A and the first fabric portion, second part 501B, when the garment 15 is worn on a body, are located about a waist area of the body. The first fabric portion, third part 501C is located at a transition of the waist area and an upper thigh area of the body. The second fabric portion 502 is located about a thigh area of the body. The third fabric portion 503 is located about a knee area of the body. The fourth fabric portion 504 is located about a calf area of the body. The fifth fabric portion 505 is located about an ankle area of the body.

Stretch fusing 95 can be applied to one or more fabric portions of the compression legging garment 15 (anywhere some additional stretch resistance or holding purpose is desired). In one aspect, stretch fusing 95 is applied to at least the first fabric portion, first part 501A of the compression legging garment 15. In another aspect, stretch fusing is applied to one or more of the first fabric portion, first part 501A, second part 501B, and third part 501C of the garment 15. In one example, stretch resistant fabric is fused to at least one segment of the circumference of the at least first fabric portion, first part 501A, to provide location specific stretch resistance and hold for the at least first fabric portion, first part 501A. In this aspect, the stretch resistant fabric can be manually applied to one or multiple segments about the circumference of the at least first fabric portion, first part 501A for fusing of the stretch resistant fabric to the at least first fabric portion, first part 501A. The one or multiple segments about the circumference of the at least first fabric portion, first part 501A can total approximately 15% to 75% of the circumference of the at least first fabric portion, first part 501A. In a specific aspect, multiple segments about the circumference of the at least first fabric portion, first part 501A include stretch fusing, where the multiple segments total approximately 50% of the circumference of the at least first fabric portion 501. In another aspect, the stretch resistant fabric is manually applied to the multiple segments of the at least first fabric portion, first part 501A, about the circumference of the at least first fabric portion, first part 501A, by pinning. The pinned, stretch resistant fabric is heated and fused to the at least first fabric portion, first part 501A. In the compression legging garment 15 of FIGS. 5*a* and 5*b*, a 100% Polyurethane (HTS code for STC-03 is 3926 9090) fabric is pressed between two pieces of the at least first fabric portion 501 at approximately 3-4 bar pressure for 10-12 seconds at 270 degrees Fahrenheit. This manual process uses a heat press machine and an iron.

FIGS. 6*a* and 6*b* illustrate a front and a back of a compression legging garment 16, in accordance with another embodiment of the present invention. In this embodiment, the compression legging garment 16 includes a first fabric portion 601 disposed about a circumference of the garment 16, comprising a waistband of the garment 16. The first fabric portion 601 can have a high 80, medium 60, or low 40 compression rating.

The compression legging garment 16 of FIGS. 6*a* and 6*b* also includes a second 602, third 603, fourth 604, and fifth 605 fabric portions disposed about at least a portion of a circumference of the garment 16. The second fabric portion 602 is located below the first fabric portion 601. The third fabric portion 603 is located below the second fabric portion 602. The fourth fabric portion 604 is located below the third fabric portion 603. The fifth fabric portion 605 is located below the fourth fabric portion 604. The second fabric portion 602 has a medium compression rating 60, less than the high compression rating 80, over a majority of a front of the garment 16, and a minimal compression rating 20, less than the low compression rating 40, around the sides and across a back of the garment 16. The third 603 and the fifth 605 fabric portions have a low compression rating 40, less than the medium compression rating 60. The fourth fabric portion 604 has a medium compression rating 60, less than the high compression rating 80, over a majority of a front of the garment 16, and a minimal compression rating 20, less than the low compression rating 40, around the sides and across a back of the garment 16. Each transition between respective fabric portions is seamless.

The compression legging garment 16 of FIGS. 6*a* and 6*b* could comprise 90% to 96% nylon and 4% to 10% elastane. The garment 16 could comprise yarns selected from the soup consisting of customized yarns of varying elasticity, antimicrobial yarns and wicking yarns. In this embodiment, the high compression rating 80 is within a range of 6.5 to 18.1 mmHg; the medium compression rating 60 is within a range of 4.3 to 14.2 mmHg; the low compression rating 40 is within a range of 2.8 to 11.0 mmHg; and the minimal compression rating 20 is within a range of 1.6 to 6.0 mmHg. In one specific embodiment, the high compression rating 80 is 18.1 mmHg the medium compression rating 60 is 14.2 mmHg; the low compression rating 40 is 11.0 mmHg and the minimal compression rating 20 is 6.0 mmHg. In another specific embodiment, the high compression rating 80 is 12.4 mmHg; the medium compression rating 60 is 9.3 mmHg; the low compression rating 40 is 6.7 mmHg and the minimal compression rating 20 is 3.1 mmHg. In still another specific embodiment, the high compression rating 80 is 6.5 mmHg the medium compression rating 60 is 4.3 mmHg; the low compression rating 40 is 2.8 mmHg; and the minimal compression rating 20 is 1.6 mmHg.

The compression legging garment 16 of FIGS. 6*a* and 6*b* is configured to be worn on a body, and can be configured so that the first fabric portion 601, when the garment 16 is worn on a body, is located about a waist area of the body. The first fabric portion 601 would also transition between the waist area and an upper thigh area of the body. The second fabric portion 602 is located about a thigh area of the body. The third fabric portion 603 is located about a knee area of the body. The fourth fabric portion 604 is located about a calf area of the body. The fifth fabric portion 605 is located about an ankle area of the body.

Stretch fusing 95 can again be applied to one or more fabric portions of the compression legging garment 16 (anywhere some additional stretch resistance or holding purpose is desired). In this embodiment, stretch fusing 95 is applied to the first fabric portion 601 of the compression legging garment 16, about the front and back of the waistband. Stretch resistant fabric is fused to at least one segment of the circumference of the first fabric portion 601, to provide location specific stretch resistance and hold for the first fabric portion 601, in this aspect, the stretch resistant fabric can be manually applied to one or multiple segments about the circumference of the first fabric portion 601 for fusing of the stretch resistant fabric to the first fabric portion 601. The one or multiple segments about the circumference of the first fabric portion 601 can total approximately 15% to 75% of the circumference of the first fabric portion 601, or an entirety of the circumference of the first fabric portion 601. In a specific aspect, multiple segments about the circumference of the first fabric portion 601 includes stretch fusing, where the multiple segments total approximately 50% of the circumference of the first fabric portion 601. In this aspect, the stretch resistant fabric is manually applied to the first fabric portion 601, about the circumference of the first fabric portion 601, by pinning. The pinned, stretch resistant fabric is heated and fused to the first fabric portion 601. In the compression legging garment 16 of FIGS. 6*a* and 6*b*, a 100% Polyurethane (FITS code for STC-03 is 3926 9090) fabric is pressed between two pieces of the first fabric portion 601 at approximately 3-4 bar pressure for 10-12 seconds at 270 degrees Fahrenheit. This manual process uses a heat press machine and an iron.

The compression legging garment 16 of FIGS. 6*a* and 6*b* also includes a differential compression zone 99 at a middle top of a back of the waistband, adjacent a lower mid-back area of a body wearing the garment. The differential compression zone 99 includes a seamless half-moon design including varying levels of differential compression material. The differential compression zone 99 allows the waistband to curve and conform to a natural lower back arch of a body, and to lay comfortably against the body.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. A compression legging garment, comprising:

a first fabric portion, first part, disposed about a circumference of the garment, the first fabric portion, first part, having a medium compression rating; and a first fabric portion, second part, and a first fabric portion, third part, disposed about the circumference of the garment; the first fabric portion, second part, located above the first fabric portion, first part, and the first fabric portion third part, located below the first fabric portion, first part; the first fabric portion, second part, having a high compression rating, greater than the medium compression rating, and the first fabric portion, third part, having a low compression rating, less than the medium compression rating; the transition between the first fabric portion, first part, and the first fabric portion, second part, and the first fabric portion, first part, and the first fabric portion, third part, being seamless; and a second, third fourth and fifth fabric portions disposed about at least a portion of the circumference of the garment; the second fabric portion located below the first fabric portion, third part, the third fabric portion located below the second fabric portion the fourth fabric portion located below the third fabric portion, and the fifth fabric portion located below the fourth fabric portion; where the second and the fourth fabric portions have the medium compression rating, less than the high compression rating, over at least a portion thereof, and a minimal compression rating, less than the low compression rating, over at least another portion thereof where the third and the fifth fabric portions have the low compression rating, less than the medium compression rating; and where the transition between the first fabric portion, third part, and the second fabric portion, the second and the third fabric portion, the third and the fourth fabric portion and the fourth and the fifth fabric portion is seamless;

wherein the high compression rating is within a range of 6.5 to 18.1 mmHg; the medium compression rating is within a range of 4.3 to 14.2 mmHg; the low compression rating is within a range of 2.8 to 11.0 mmHg; and the minimal compression rating is within a range of 1.6 to 6.0 mmHg.

2. The garment of claim 1, wherein the first fabric portion, first part, and the first fabric portion, second part forma waistband portion such that, when the garment is worn on a body, the waistband portion is configured to be located about a waist area of the body, and the first fabric portion, third part, is located at a transition of the waist area and an upper thigh area of the body.

3. The garment of claim 2, further comprising a differential compression zone at the waistband portion, the differential compression zone being seamless and including varying levels of differential compression material, thereby allowing the waistband portion to conform to a natural lower back arch of a body wearing the garment.

4. The garment of claim 3, wherein the differential compression zone has a half-moon design.

5. The garment of claim 1, wherein a stretch resistant fabric is fused to at least a segment of the circumference of the at least first fabric portion, first part, to provide location specific stretch resistance to the at least first fabric portion, first part.

6. The garment of claim 5, wherein the stretch resistant fabric is manually applied to multiple segments of the at least first fabric portion, first part, about the circumference of the at least first fabric portion, first part, for fusing of the stretch resistant fabric to the at least first fabric portion, first part, the multiple segments of the manually applied stretch resistant fabric covering approximately 50% of the circumference of the at least first fabric portion, first part.

7. The garment of claim 6, wherein the stretch resistant fabric is manually applied to the multiple segments of the at least first fabric portion, first part, about the circumference of the at least first fabric portion, first part, by pinning, and the stretch resistant fabric is heated and fused to the at least first fabric portion, first part.

8. The garment of claim 7, wherein the stretch resistant fabric is 100% Polyurethane and is fused to the at least first fabric portion, first part.

9. The garment of claim 1, wherein the garment is configured to be worn on a body so that the first fabric portion, first part, and the first fabric portion, second part, when the legging garment is worn on a body, is located about a waist area of the body; the first fabric portion, third part, is located at a transition of the waist area and an upper thigh area of the body; the second fabric portion is located about a thigh area of the body; the third fabric portion is located about a knee area of the body; the fourth fabric portion is located about a calf area of the body; and the fifth fabric portion is located about an ankle area of the body.

10. The garment of claim 1, wherein the high compression rating is 12.4 mmHg; the medium compression rating is 9.3 mmHg; the low compression rating is 6.7 mmHg; and the minimal compression rating is 3.1 mmHg.

11. A compression legging garment, comprising:

a first fabric portion disposed about a circumference of the garment, where the first fabric portion has a high, medium or low compression rating; and a second, third, fourth and fifth fabric portions disposed about at least a portion of the circumference of the garment; the second fabric portion located below the first fabric portion, the third fabric portion located below the second fabric portion, the fourth fabric portion located below the third fabric portion, and the fifth fabric portion located below the fourth fabric portion; where the second and the fourth fabric portions have the medium compression rating, less than the high compression rating, over at least a portion thereof, and a minimal compression rating, less than the low compression rating, over at least another portion thereof, where the third and the fifth fabric portions have the low compression rating, less than the medium compression rating; and where the transition between the first and the second fabric portion, the second and the third fabric portion, the third and the fourth fabric portion, and the fourth and the fifth fabric portion, is seamless; and a differential compression zone at a middle top of a back of the first fabric portion, the differential compression zone being seamless and including varying levels of differential compression material, thereby allowing the first fabric portion to conform to a natural lower back arch of a body wearing the garment;

wherein the garment is configured to be worn on a body so that the first fabric portion, when the legging garment is worn on a body, is located about a waist area of the body; the second fabric portion is located about a thigh area of the body; the third fabric portion is located about a knee area of the body; the fourth fabric portion is located about a calf area of the body; and the fifth fabric portion is located about an ankle area of the body.

12. The garment of claim 11, wherein a stretch resistant fabric is fused to at least a segment of the circumference of the first fabric portion to provide location specific stretch resistance to the at least first fabric portion.

13. The garment of claim 12, wherein the stretch resistant fabric is manually applied, by pinning, about the circumference of the first fabric portion for fusing of the stretch resistant fabric to the first fabric portion, where the stretch resistant fabric is 100% Polyurethane fused to the first fabric portion.

14. The garment of claim 11, wherein the differential compression zone has a half-moon design.

15. A compression legging garment, comprising:

a first fabric portion disposed about a circumference of the garment, where the first fabric portion has a high, medium or low compression rating; and a second, third, fourth and fifth fabric portions disposed about at least a portion of the circumference of the garment; the second fabric portion located below the first fabric portion, the third fabric portion located below the second fabric portion, the fourth fabric portion located below the third fabric portion, and the fifth fabric portion located below the fourth fabric portion; where the second and the fourth fabric portions have the medium compression rating, less than the high compression rating, over at least a portion thereof, and a minimal compression rating, less than the low compression rating, over at least another portion thereof, where the third and the fifth fabric portions have the low compression rating, less than the medium compression rating; and where the transition between the first and the second fabric portion, the second and the third fabric portion, the third and the fourth fabric portion, and the fourth and the fifth fabric portion, is seamless;

wherein the high compression rating is within a range of 6.5 to 18.1 mmHg; the medium compression rating is within a range of 4.3 to 14.2 mmHg; the low compression rating is within a range of 2.8 to 11.0 mmHg; and the minimal compression rating is within a range of 1.6 to 6.0 mmHg.

16. The garment of claim 15, wherein the high compression rating is 12.4 mmHg; the medium compression rating is 9.3 mmHg; the low compression rating is 6.7 mmHg; and the minimal compression rating is 3.1 mmHg.

17. A compression legging garment, comprising: a first fabric portion, first part, disposed about a circumference of the garment, the first fabric portion, first part, having a medium compression rating;

and a first fabric portion, second part, and a first fabric portion, third part, disposed about the circumference of the garment; the first fabric portion, second part, located above the first fabric portion, first part, and the first fabric portion, third part, located below the first fabric portion, first part; the first fabric portion, second part, having a high compression rating, greater than the medium compression rating, and the first fabric portion, third part, having a low compression rating, less than the medium compression rating; the first fabric portion, first part, and the first fabric portion, second part forming a waistband portion; the transition between the first fabric portion, first part, and the first fabric portion, second part, and the first fabric portion, first part, and the first fabric portion, third part, being seamless;

a second, third, fourth, and fifth fabric portions disposed about at least a portion of the circumference of the garment; the second fabric portion located below the first fabric portion, third part, the third fabric portion located below the second fabric portion, the fourth fabric portion located below the third fabric portion, and the fifth fabric portion located below the fourth fabric portion; where the second and the fourth fabric portions have the medium compression rating, less than the high compression rating, over at least a portion thereof, and a minimal compression rating, less than the low compression rating, over at least another portion thereof, where the third and the fifth fabric portions have the low compression rating, less than the medium compression rating; and where the transition between the first fabric portion, third part, and the second fabric portion, the second and the third fabric portion, the third and the fourth fabric portion, and the fourth and the fifth fabric portion, is seamless; and a differential compression zone at the waistband portion, the differential compression zone being seamless and including varying levels of differential compression material, thereby allowing the waistband portion to conform to a natural lower back arch of a body wearing the garment;

wherein the garment is configured to be worn on a body so that the first fabric portion, first part, and the first fabric portion, second part, when the legging garment is worn on a body, is located about a waist area of the body; the first fabric portion, third part, is located at a transition of the waist area and an upper thigh area of the body; the second fabric portion is located about a thigh area of the body; the third fabric portion is located about a knee area of the body; the fourth fabric portion is located about a calf area of the body; and the fifth fabric portion is located about an ankle area of the body.

18. The garment of claim 17, wherein the differential compression zone has a half-moon design.

* * * * *